United States Patent [19]

Rice

[11] Patent Number: 5,044,633

[45] Date of Patent: Sep. 3, 1991

[54] OFFICE CHAIR WITH OCCASIONAL EXERCISE CAPABILITY

[76] Inventor: Bryan A. Rice, 1425 11th St., Santa Monica, Calif. 90401

[21] Appl. No.: 639,138

[22] Filed: Jan. 9, 1991

[51] Int. Cl.[5] ..... A63B 21/00

[52] U.S. Cl. ..... 272/144; 272/134; 272/136

[58] Field of Search ..... 272/117, 136, 142, 134, 272/144; 128/32; 248/188.7; 297/217

[56] References Cited

U.S. PATENT DOCUMENTS

| | | | |
|---|---|---|---|
| 4,913,423 | 4/1990 | Farran | 272/134 |
| 4,921,247 | 5/1990 | Sterling | 272/134 |
| 5,002,271 | 3/1991 | Gonzales | 272/134 |

*Primary Examiner*—Richard J. Apley
*Assistant Examiner*—Jerome Donnelly
*Attorney, Agent, or Firm*—Arthur Freilich; Robert D. Hornbaker; Leon D. Rosen

[57] ABSTRACT

A chair is provided that functions well as an ordinary office chair, and which can be used to perform exercises. The chair includes all the attributes of a comfortable office chair, including a padded seat with a seat bottom and seat back, and a pedestal with casters that rollably support the seat on a chair pad lying behind an office desk. The seat back (18, FIG. 1) has an upper part (32) with extendable handles (34, 36) that can be grasped to raise and lower it while a mechanism resists vertical movement to provide exercise. The seat has armrests (100, 102) that each have a moveable portion with extendable handles (114) and a resistance mechanism (115) to provide exercise in raising and lowering the armrests. The chair also has an extendable mechanism (140) mounted under the seat bottom and having a pair of foot handles (150, 152) that allow the seated person to move the handles forward and back for further exercise. All exercise mechanisms of the chair can be deployed, used, and stowed while the person remains seated, so the person is encouraged to conduct exercises during brief appropriate periods such as when the person is talking on a speaker phone.

9 Claims, 5 Drawing Sheets

OFFICE CHAIR WITH OCCASIONAL EXERCISE CAPABILITY

BACKGROUND OF THE INVENTION

Specialized exercise equipment is available wherein a person performs specific exercises while seated. A first type includes a device with handles that lie at about the height of a person's head, and which can be grasped to lift and lower the handles against the resistance of weights. A second type of device includes handles lying in front of the person at waist level, which can be grasped to lift and lower the handles against weights. A third type includes foot handles, wherein a person places the bottom of his legs or his feet under the handles and moves them in a forward upper incline against the resistance of weights.

An office worker often has short brief periods of time in which he can perform exercises, such as when talking on a speaker phone and waiting of the called party to come to the phone. It would be desirable if the office worker could perform exercises during these brief periods of time while remaining seated in his office chair. It would be even more desirable if the exercises were similar to those performed on specialized equipment in a gym or health club which the office worker may already be acquainted with and which are known to be useful. By performing exercises known to the office worker to be similar to those performed in a health club or gym, the worker is encouraged to perform such exercises because he knows that his body is achieving the same type of benefit as if he attended his health club, which he may not have enough time to regularly attend. However, in order for such office exercise apparatus to gain acceptance, it must not interfere with comfortable seating of the office worker at his or her desk and movement in the desk area by swiveling in the seat or moving the seat on a desk pad.

SUMMARY OF THE INVENTION

In accordance with one embodiment of the present invention, a chair is provided that fully serves the function of an office chair, and yet which enable exercises to be readily performed by the seated person wherein the exercises are closely similar to those commonly available on specialized equipment in health clubs and gyms. The chair has a padded seat with a seat bottom and back to comfortably support a seated person, and has a pedestal with casters that readily support the chair on a seat pad or other floor surface that lies behind an office desk. The chair has moveable parts with handles for grasping by the seated person, and with resistance mechanisms that resist movement of the parts to provide exercise to the person.

The seat back can include a stationary lower part and a head rest or upper part with handles that can be grasped by a person raising his arms over and slightly behind his head. The upper seat part can be moved up and down, and a mechanism resists at least upward movement to provide exercise simulating that obtained in a health club. The chair can also include arm rests that each have a moveable part with a handle that can be grasped to raise and lower the arm rest against the resistance of a resistance mechanism. The chair can also include a pair of foot handles positioned so the lower legs or feet of a person can be placed under and behind the foot handles, so that the foot handles can be moved in a largely forward or inclined forward direction against the resistance of a resistance mechanism.

The novel features of the invention are set forth with particularity in the appended claims. The invention will be best understood from the following description when read in conjunction with the accompanying drawings.

DESCRIPTION OF THE PREFERRED EMBODIMENT

Figure 1:
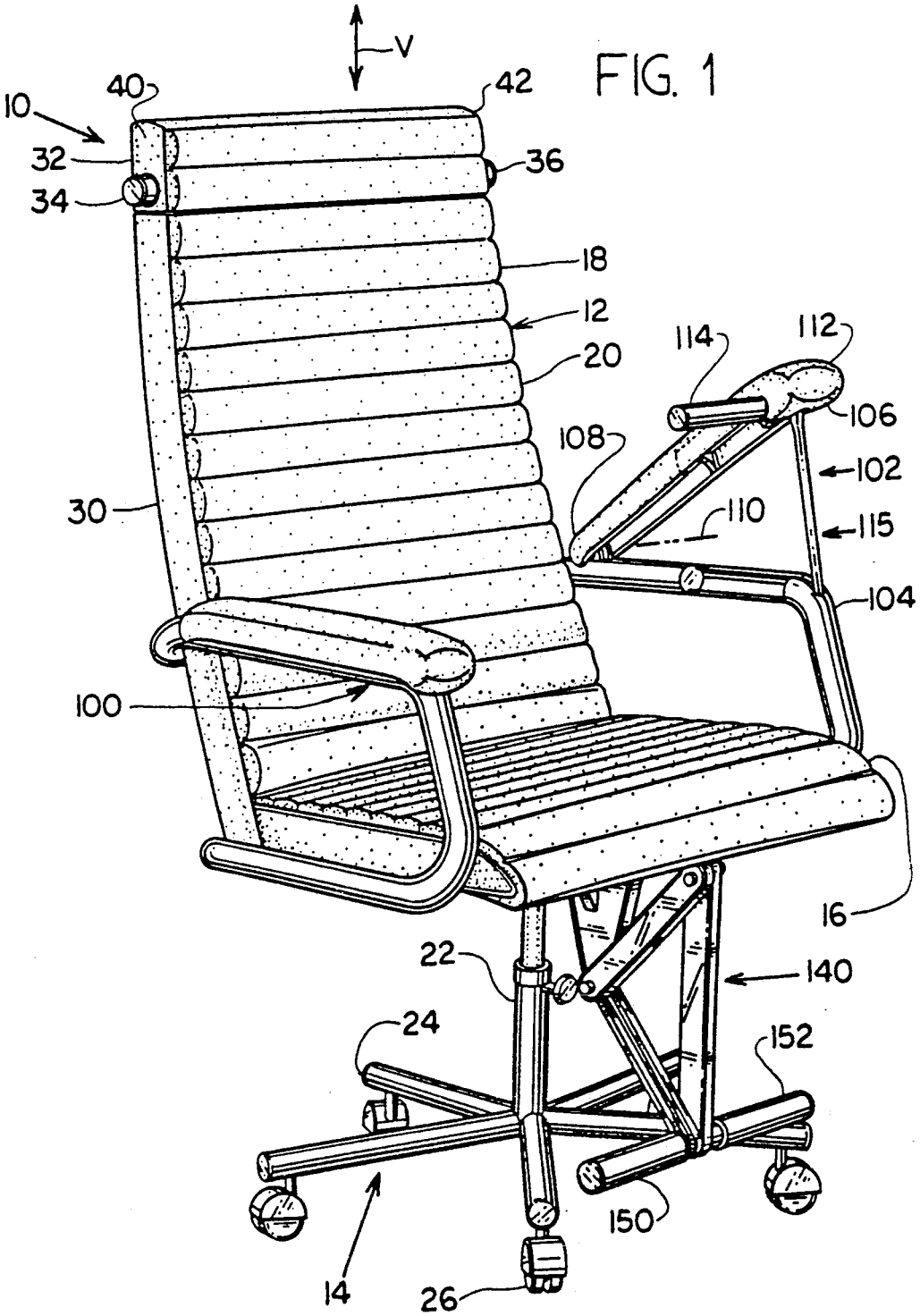
FIG. 1 is a perspective view of an office chair with occasional exercise capability, constructed in accordance with the present invention, with one of the moveable arm rest portions raised but with the rest of the exercise apparatus in their stowed positions.

FIG. 1 illustrates an office chair 10 with exercise capability, which includes a padded seat 12 supported by a pedestal 14 on the ground. The seat includes a seat bottom 16 for supporting a seated person and a seat back 18 for supporting the back of the person. Padding 20 covers the seat bottom and the seat back to comfortably support the person. The pedestal has a column 22 of adjustable length which supports the seat bottom to allow it to swivel about a vertical axis. The pedestal also has a lower frame 24 with a plurality of casters 26 that can roll on the ground. Thus, the office chair has all the amenities of a typical office chair of comfortably supporting a seated person, while allowing him to swivel and roll on the ground as on a chair pad located on the floor behind a desk.

The seat back 18 has a lower part 30 extending along most of the height of the seat back, and also includes a separate upper part 32. The upper part has handles 34, 36 that are shown in a stowed position wherein most of each handle is hidden from sight. The handles can be extended so they can be grasped, to allow the seated person to move the upper part 32 vertically as indicated by arrow V to provide exercise for him.

Figure 2:
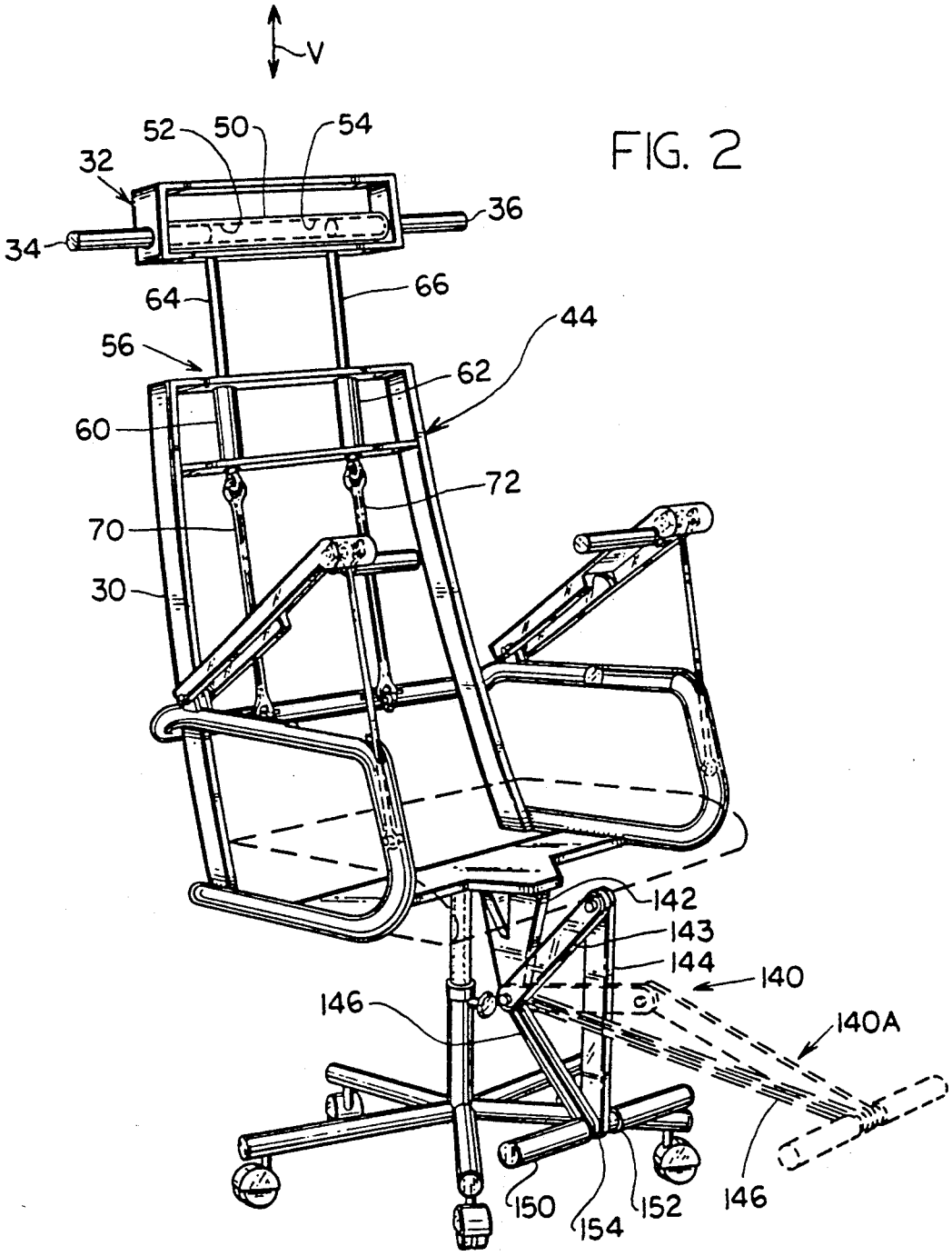
FIG. 2 is a view similar to that of FIG. 1, but showing only the framework of the chair and showing how all the exercise apparatus moves.

FIG. 2 illustrates the framework 44 of the office chair, that is, the chair without the padding thereon. The handles 34, 36 on the upper part of the seat back ar shown in their deployed position, wherein they project from the end portions of the upper seat back 32 for the grasping by the hands. The upper part includes a tube 50 forming a pair of cavities 52, 54 which can receive the handles 34, 36 in their stowed positions, and which allows the handles to be slid outwardly to their deployed positions. A guide and resistance mechanism 56 guides the upper part 32 of the seat back in largely vertical movement relative to the lower part 30, and provides resistance (e.g. 20 to 50 pounds) to vertical movement, at least for upward movement over a period on the order of a second. The mechanism includes a pair of guide tubes 60, 62 mounted in the lower part 30 of the seat back, and a pair of shafts 64, 66 attached to the upper part 32 and slideable in the tubes, to guide the upper part in vertical movement. The mechanism also includes a pair of elastomeric member 70, 72 that must be stretched to lift the upper part 32, to thereby provide resistance to such upward movement.

Figure 4:
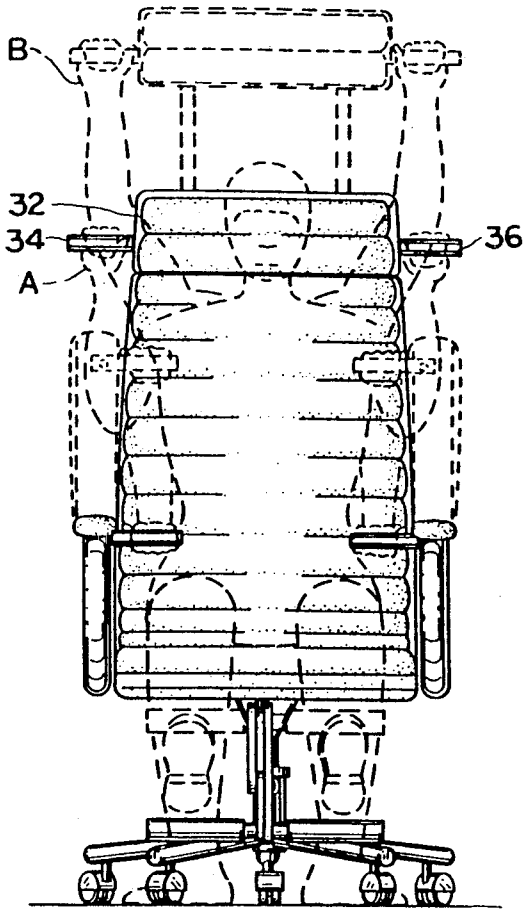
FIG. 4 is a front view of the chair of FIG. 3.
Figure 3:
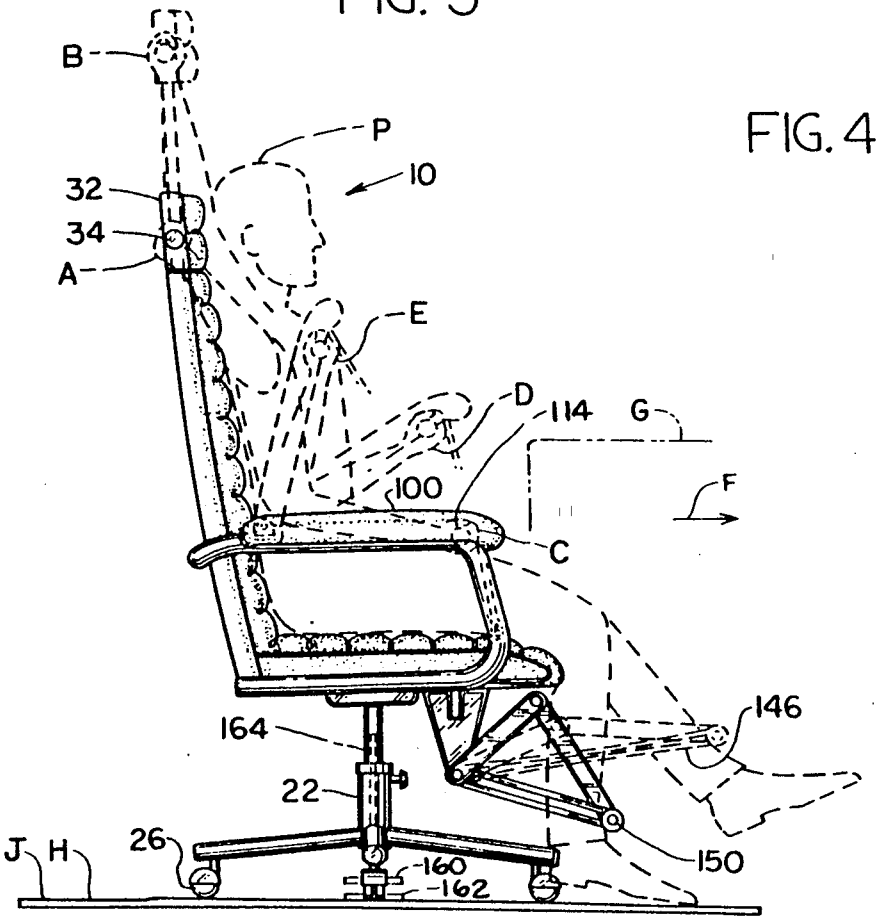
FIG. 3 is a right side view of the chair of FIG. 1, showing how it can be used by an office worker at his desk.

FIGS. 3 and 4 show a person P seated in the office chair 10 with his arms raised and his hands grasping the handles 34, 36 to perform an exercise that strengthens his upper body muscles, and which simulates equipment commonly found in health clubs. When the seat back 32 is in the lower position, the person's hands at A are at about the height of his head, while when the seat back is fully raised the persons hands at B are raised by about one foot above the level at A.

Figure 5:
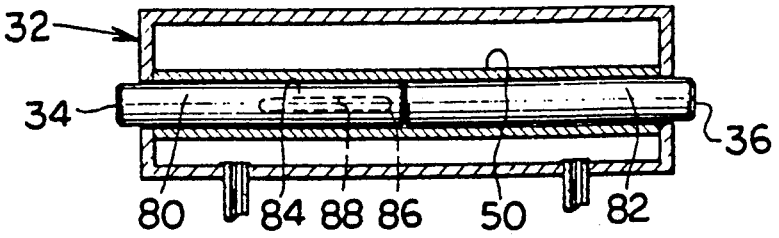
FIG. 5 is a front sectional view of the upper seat part, with the handles in a stowed position.
Figure 6:
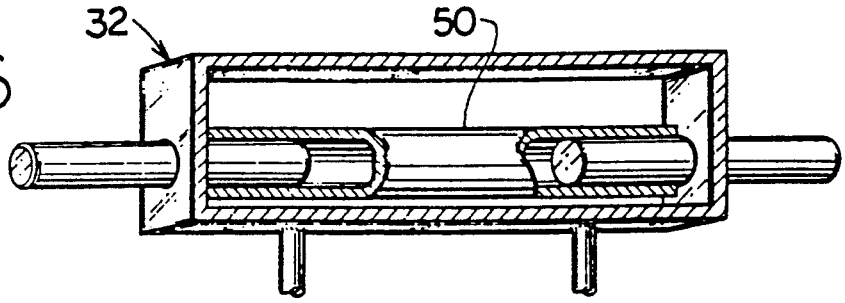
FIG. 6 is a perspective view of the upper seat part of FIG. 5, with the handles in a deployed position.

FIG. 5 and 6 sown additional details of the seat back upper part 32. Each of the handles 34, 36 is part of a rod 80, 82 with an inner position 84 forming a support and an outer portion forming the handle 34. The inner portion can be restrained from moving outwardly past the deployed position, as by a pin 86 which slides along a slot 88 in the tube 50.

FIGS. 5 and 6 show additional details of the seat back upper part 32. Each of the handles 34, 36 is part of a rod 80, 82 with an inner portion 84 forming a support and an outer portion forming the handle 34. The inner portion can be restrained from moving outwardly past the deployed position, as by a pin 86 which slides along a slot 88 in the tube 50.

Figure 7:
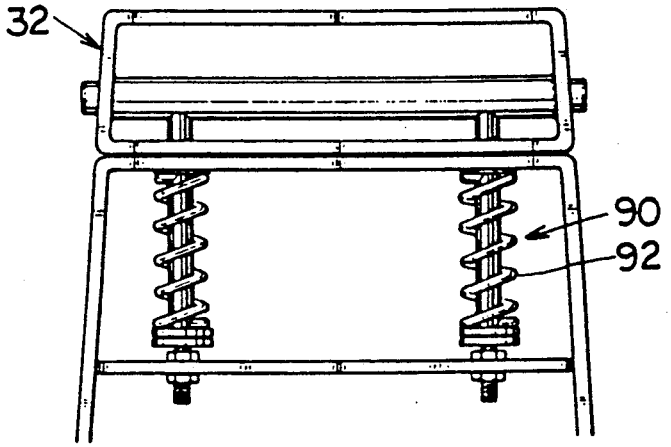
FIG. 7 is a sectional front view of a seat back exercise apparatus constructed in accordance with another embodiment of the user, wherein the resistance mechanism includes coil springs.
Figure 8:
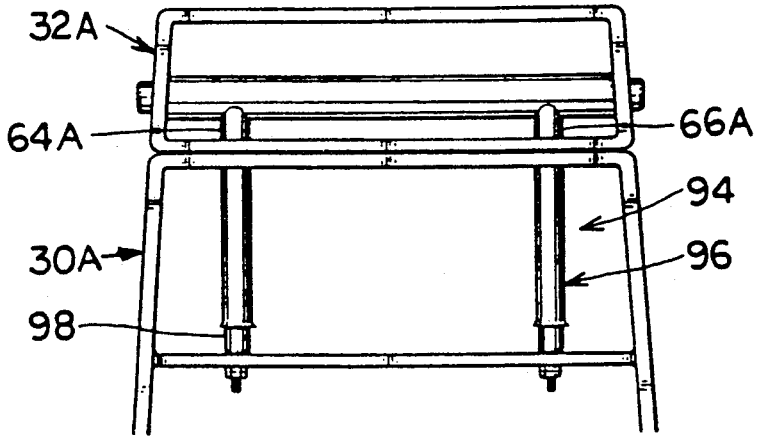
FIG. 8 is a sectional front view of a seat back exercise apparatus of another embodiment of the invention, wherein the resistance mechanism includes hydraulic or pneumatic tubes.

FIGS. 7 and 8 shown other guide and resistance mechanisms, with different apparatus for resisting movement of the upper part of the seat back. FIG. 7 shows a mechanism 90 which includes a coil spring 92 that is compressed as the upper part 32 is raised. The upper part 32 is guided in vertical movement in the same manner as shown in FIG. 2. FIG. 8 shows a mechanism 94 which includes a hydraulic or pneumatic tube 96 for resisting movement of the upper part 32A. Shafts 64A, 66A which serve to guide the upper part in vertical movement, also act as cylinders that slide within pistons 98 attached to the lower part 30A of the seat back. The flow of fluid such as air into the upper end of the cylinder such as 64A as it expands in volume when the seat back upper 32 is raised, is restricted, to provide resistance to both raising and lowering of the set back upper part 32A.

Referring again to FIG. 1, it can be seen that the office chair includes a pair of armrests 100, 102 that also have exercise capability. Each armrest includes a stationary portion 104 and a moveable portion 106. The moveable portion has a rear part 108 that is pivotable about a largely horizontal axis 110 on the stationary portion 104. The moveable armrest portion also has a front part 112 with a handle 114 that can be grasped by a seated person to raise and lower the front part 112. A resistance mechanism 115 resists pivoting of the moveable armrest portion about the axis 110, at least in a direction to lift the moveable front part 112.

Figure 9:
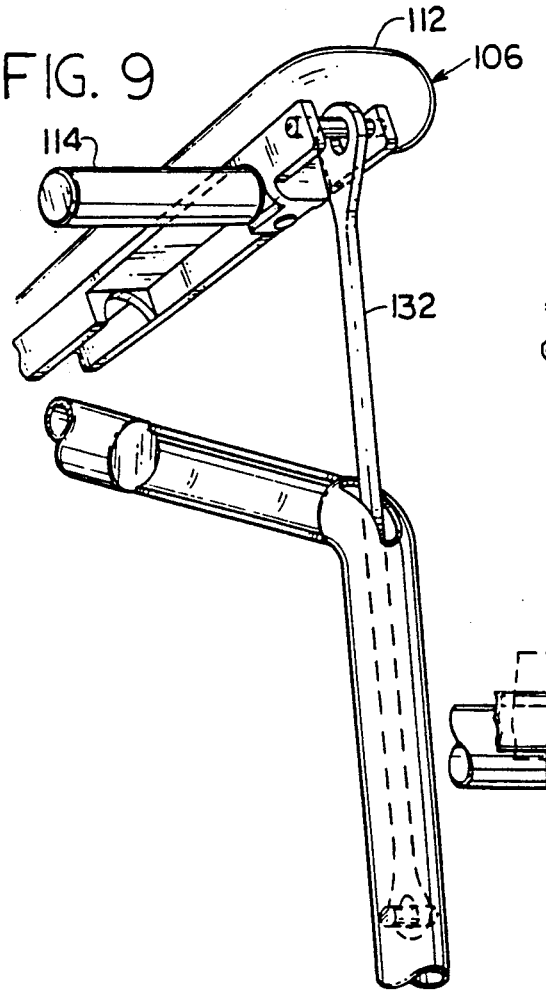
FIG. 9 is a partial perspective view of an armrest exercise apparatus of FIG. 2, with the handle in a deployed position.
Figure 10:
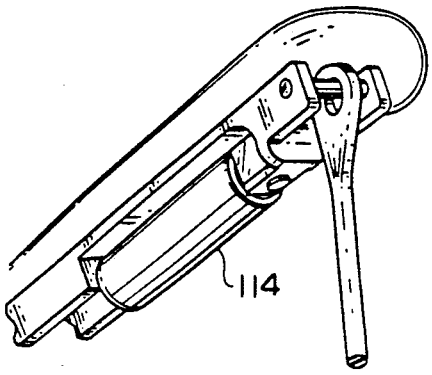
FIG. 10 is a partial perspective view of the apparatus of FIG. 9, with the handle in a stowed position.
Figure 11:
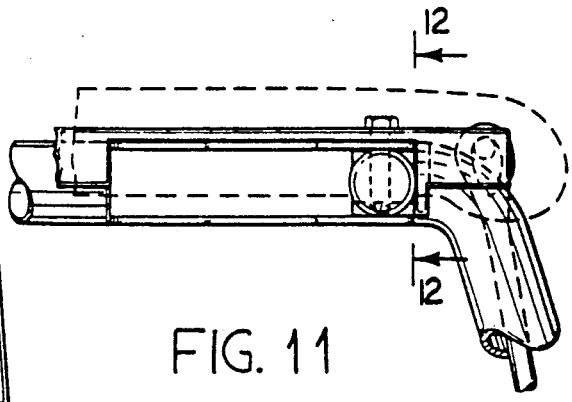
FIG. 11 is a side elevation view of the apparatus of FIG. 10, with the padding shown in dashed lines.
Figure 12:
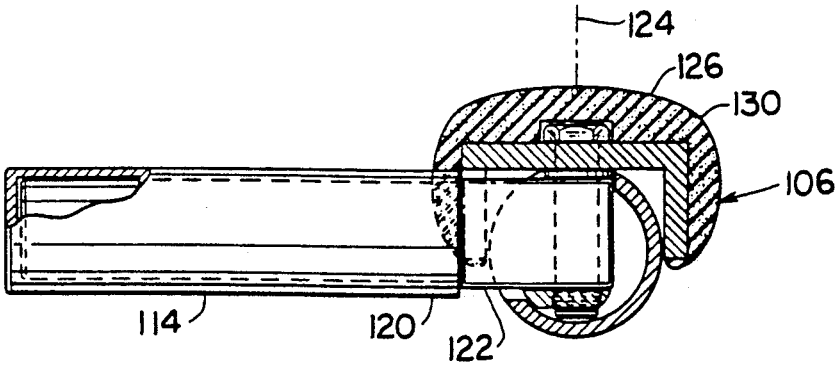
FIG. 12 is a view taken on the line of 12-12 of FIG. 11, but with the handle in a deployed position.

As shown in FIGS. 9–12, the handle 114 can be moved from a stowed position shown in FIG. 10, to the deployed position shown in FIG. 9. The handle has an inner portion 120 (FIG. 12) that is mounted on a bracket 122. The bracket is pivotally mounted, about a substantially vertical axis 124 by a bolt 126, to the moveable armrest portion 106. This figure also shows a padding layer 130 which lies over the metal framework of the moveable portion of the armrest.

Each handle 114 is normally stowed so it is substantially hidden, in that it cannot be readily seen by a standing or seated person who looks down at the armrest. However, the handles can be easily pivoted to a deployed position. As shown in FIG. 3, in the deployed position the hand of the person at C can grasp the handle at 114 and raise his arms to the position D and E against the resistance mechanism. As shown in FIG. 9, the resistance mechanism can include an elastic member 132 which resists upward movement of the front part of the moveable armrest portion. It is also possible to use a spring, or a hydraulic or pneumatic cylinder such as shown in FIG. 8.

Referring again to FIG. 1, it can be seen that the office chair also includes an extendable mechanism 140 that can exercise the leg muscles of a person seated in the chair. As shown in FIG. 2, the chair includes a bracket 142 preferably mounted on the seat bottom, and which supports the extendable mechanism 140. The mechanism 140 includes a two bar linkage having inner and outer bars 143, 144 and an elastic member 146 connecting a location near the inner end of the inner bar 143 to a location near the outer end of the outer bar 144. A pair of foot handles 150, 152 are attached to the outer end 154 of the outer bar. The two bar linkage can be extended, as to the position 140A by stretching of the elastomeric member 146. As shown in FIG. 3, the seated person can place the lower parts of his legs or his feet under the handles such as 150 and extend his legs to extend the mechanism against the force provided by the elastomeric member 156. This exercise the calf muscles of the legs and thighs.

Other resistance mechanisms can be used instead of the elastomeric member 1456 to provide resistance to movement of the foot handles. For example, two telescoping members such as a piston and cylinder can be used, with resistance obtained through the flow of hydraulic or pneumatic (air) fluid or by an elastomeric member extending through the middle of the telescoping members.

FIG. 3 shows how the chair 10 may be used in an office environment, where the person P is seated in front of a desk G, with the person facing in the forward direction F towards the desk. The rollers or casters 26 lie on a floor surface H, which is preferably formed by the upper surface of a chair pad J that lies on a carpet of an office behind the desk. The person has complete freedom to use the office chair in the manner as an ordinary office chair, and yet he is able to perform exercises commonly provided in health clubs while seated at the chair. The chair is of an attractive appearance similar to ordinary "executive " office chairs. The handles at the upper part 32 of the seat back and at the armrests such as 100 are largely hidden. The foot rests are not hidden, although the fact that they lie close to the floor results in their being hidden by the desk from persons seated or standing in front of the desk. When any of the above-described exercises are performed, the chair remains stably supported on the floor. However, vigorous exercise may cause the chair to roll back and forth slightly. This can be avoided by apparatus for preventing rolling of the casters, such as by a pad that is normally in a raised position off the floor, such as shown at 160, but which can be lowered to the position 162, the pad being mounted on a shaft 164 that slides within the pedestal column 22, and being raised and lowered by a mechanism (not shown).

Although particular embodiments of the invention have been described and illustrated herein, it is recognized that modifications and variations my readily occur to those skilled in the art, and consequently, it is intended that the claims be interpreted to cover such modifications and equivalents.

I claim:

1. An office chair with occasional exercise capability comprising:

a seat having a seat bottom for supporting a seated person and a seat back for supporting the back of the person, said bottom and back being padded to comfortably support the person;

a pedestal having an upper part that supports said seat bottom and a lower part, said lower part having a plurality of casters for rolling on the ground;

said seat back having a lower part extending along most of the height of the seat back, an upper part, and a guide and resistance mechanism which guides said upper part in primarily vertical movement relative to said seat back lower part and which resists vertical movement of said upper part while allowing such movement by a force applied by a person seated in the chair, said seat back upper part being homogeneous in structure with said seat back lower part, said seat back upper part having opposite end portions and having a pair of handles located at each of said end portions, said handles being positioned to be grasped by the raised arms of a person seated in said chair.

2. The office chair described in claim 1 wherein:

said seat back upper part end portions have cavities, said handles normally lying in said cavities s most of each of said handles is hidden, but said handles being deployable out of said cavities so they can be grasped.

3. An office chair with occasional exercise capability comprising:

a seat having a seat bottom for supporting a seated person and a seat back for supporting the back of the person, said bottom and back being padded to comfortably support the person;

a pedestal which supports said seat bottom above the ground, said pedestal including a lower part having a plurality of casters that rollably support said pedestal on the ground;

said seat also including a pair of opposite armrests positioned to support the arms of the seated person;

each of said armrests has a stationary armrest portion and a moveable armrest portion, said moveable armrest portion lying near the front of the armrest and being moveable largely vertically with respect to said stationary portion, and each of said armrests has a resistance mechanism which resists and largely vertical movement, said moveable armrest portion having a handle which can be moved from a stowed position wherein most of the handle is hidden to a deployed position wherein most of the handles is displayed and wherein the handle extends primarily horizontally and towards the opposite armrest, each moveable arm rest portion is elongated and has a rearward part that is pivotally couples to said stationary portion about a primarily horizontal axis.

4. The office chair described in claim 3 wherein:

said elongated moveable armrest portion having an upper surface that is padded to comfortably support the arm of the seated person.

5. The office chair described in claim 4 wherein:

each of said handles is elongated and extends substantially parallel to the elongated moveable armrest portion in the stowed position, each handle having an inner portion which is pivotally mounted on the corresponding elongated moveable armrest portion about a largely vertical axis to pivot between said stowed and deployed positions.

6. An office chair with occasional exercise capability comprising:

a seat having a seat bottom for supporting a seated person who faces in a forward direction and a seat back for supporting the back of the person, said bottom and back being padded to comfortably support the person;

a pedestal which supports said seat bottom above the ground, said pedestal including a lower part having a plurality of casters that rollably support said pedestal on the ground;

an extendable mechanism mounted on said seat positioned below the level of said seat bottom, said extendable mechanism including a bracket means, an inner bar and an outer bar having first and second ends, said first end of said inner bar being pivotally connected to said bracket means and said second end of said inner bar being pivotally connected to said first end of said outer bar having a pair of foot handles connected to said second end of said outer bar, said handles positioned to allow a person sitting on said seat bottom to fit his legs under said handles, said mechanism being constructed to allow movement of said foot handles along a path extending largely forwardly while resisting said handle movement along said path.

7. The office chair described in claim 6 including:

an anti-rolling mechanism located on said pedestal and being manually operable to prevent rolling of said chair on the ground.

8. In an office which includes a floor, a desk on said floor, chair pad on said floor behind said desk, and an office chair having a pedestal with a lower part having casters lying on said pad and an upper part, a seat supported on said pedestal upper part wherein said seat has a padded seat bottom for sitting on and a padded seat back for supporting the back of the seated person, the improvement wherein:

said seat back has homogeneous upper and lower parts, and has a mechanism for guiding said upper seat part in primarily vertical movement up away from said lower seat back part and then down toward it and for resisting at least upward movement of said upper set back part;

said upper seat back part has opposite sides;

a pair of handles each projecting from a different one of said opposite sides of said upper seat back part, to allow said handles to be grasped by a person sitting in said seat.

9. The improvement described in claim 8 wherein: said opposite sides of said upper seat back part each have a recess, and each of said handles is moveable between a stowed position wherein it lies in one of said recessed and a deployed position wherein it projects from one of said sides of said upper seat back part.

* * * * *